US009901165B2

(12) United States Patent
Sampaio

(10) Patent No.: US 9,901,165 B2
(45) Date of Patent: Feb. 27, 2018

(54) DISPENSING BRUSH

(71) Applicant: Casabella Holdings, L.L.C., Congers, NY (US)

(72) Inventor: Andre Sampaio, Valley Cottage, NY (US)

(73) Assignee: Casabella Holdings, L.L.C., Congers, NY (US)

( * ) Notice: Subject to any disclaimer, the term of this patent is extended or adjusted under 35 U.S.C. 154(b) by 0 days.

(21) Appl. No.: 14/977,015

(22) Filed: Dec. 21, 2015

(65) Prior Publication Data

US 2017/0172290 A1 Jun. 22, 2017

(51) Int. Cl.
*B43K 5/02* (2006.01)
*A46B 11/00* (2006.01)
*B05C 17/005* (2006.01)

(52) U.S. Cl.
CPC ..... *A46B 11/001* (2013.01); *A46B 11/002* (2013.01); *A46B 11/0055* (2013.01); *B05C 17/00569* (2013.01)

(58) Field of Classification Search
CPC ..... A46B 11/06; A46B 11/00; A46B 11/001; A46B 11/002; A46B 11/0055; A47L 13/26; A47L 25/08; A47L 13/12; B05C 17/00569
USPC ..... 401/13, 279, 137, 289, 188 R, 270
See application file for complete search history.

(56) References Cited

U.S. PATENT DOCUMENTS 854,151 A 5/1907 Deasy
2,103,493 A * 12/1937 Robertson ..... A46B 11/0058 222/192
2,312,108 A * 2/1943 Mead ..... A46B 11/0013 222/473
D269,565 S 7/1983 Goldstaub
D329,752 S 9/1992 Murphy
5,213,430 A 5/1993 Pandola
D356,446 S 3/1995 Hoagland
D357,124 S 4/1995 Greenhouse
5,452,961 A * 9/1995 Lu ..... A46B 11/066 401/281
D376,262 S 12/1996 Ancona
D431,367 S 10/2000 Burkhardt
D437,691 S 2/2001 Weiss
6,499,175 B1 * 12/2002 Osiecki ..... A46B 5/02 15/145
6,595,712 B2 * 7/2003 Sickler ..... A46B 11/06 401/137
6,746,166 B1 * 6/2004 Jeon ..... A46B 11/0041 401/13

(Continued)

FOREIGN PATENT DOCUMENTS

DE 10250992 A1 5/2004

*Primary Examiner* — Jennifer C Chiang

(74) *Attorney, Agent, or Firm* — Curtis, Mallet-Prevost, Colt & Mosle, LLP

(57) ABSTRACT

A dispensing brush having a novel integrated dispensing system for delivering cleaning solutions and similar liquids to a surface to be cleaned. The dispensing system has a reservoir for liquid retention that is coupled to the dispensing brush. An integral pump dispenses the liquid from the reservoir and through a nozzle to a surface to be cleaned. The pump is actuated from a lever that is depressed by a user, at times repeatedly, to facilitate pumping of the liquid onto a surface to be cleaned by scrubbing action of the dispensing brush.

16 Claims, 14 Drawing Sheets

(56) References Cited

U.S. PATENT DOCUMENTS

| | | | | |
|---|---|---|---|---|
| D493,287 | S | 7/2004 | Hay | |
| 7,040,830 | B2 * | 5/2006 | Kliegman | A46B 11/0013 401/187 |
| 7,682,097 | B2 * | 3/2010 | Knopow | A47L 1/15 401/136 |
| D613,070 | S | 4/2010 | Huang | |
| 8,109,685 | B1 * | 2/2012 | Vito | A46B 5/0095 401/188 R |
| 8,128,303 | B2 * | 3/2012 | LaFlamme | A45D 34/04 222/383.1 |
| D672,150 | S | 12/2012 | Chitayat | |
| 8,468,635 | B2 * | 6/2013 | Nikitczuk | A46B 11/002 15/22.1 |
| 8,684,619 | B2 * | 4/2014 | Uchiyama | A46B 5/0058 15/143.1 |
| 9,212,039 | B1 * | 12/2015 | Reidy | A46B 15/0055 |
| 2003/0108378 | A1 * | 6/2003 | Sickler | A46B 11/06 401/289 |
| 2004/0265042 | A1 * | 12/2004 | Chan | A46B 11/0055 401/270 |
| 2012/0096662 | A1 * | 4/2012 | Uchiyama | A46B 5/0058 15/160 |
| 2012/0301208 | A1 | 11/2012 | Hughes | |
| 2016/0157596 | A1 * | 6/2016 | Fifield | A46B 11/0055 15/104.94 |

* cited by examiner

DISPENSING BRUSH

BACKGROUND OF THE INVENTION

1. Field of the Invention

This invention relates generally to cleaning devices, and more specifically to a dispensing brush that delivers a cleaning solution from the brush without the need for a separate cleaning solution dispenser.

2. Description of Related Art

Cleaning and scrub brushes have been used throughout the years as tools to facilitate the cleaning of objects where undesirable material is stubbornly attached to the object, requiring mechanical abrasion of the undesirable material for proper cleaning. These brushes have a plurality of bristles that emanate from a pad or similar backing and provide abrasive cleaning action when the brush is moved over the object to be cleaned, often times repeatedly. Brushes to clean objects have taken on a variety of forms over the years, and have included many different bristle materials and bristle configurations. What has commonly become known as a scrub brush has a handle or similar gripping surface and a plurality of bristles attached to a backing. The handle or gripping surface allows the user to firmly grasp the scrub brush and move it across the surface of an object to be cleaned, often repeatedly and with varying amounts of downward force.

While there are times when a cleaning brush can be effectively used without a solvent or cleaning solution, often a cleaning solution, solvent or other such liquid will make the cleaning process easier and more effective. The cleaning solution is often applied to the object to be cleaned either before scrubbing with the brush or during the scrubbing operation. The way in which the cleaning solution is applied in conjunction with the brushing operation is often a matter of personal preference, and a variety of containers to retain the cleaning solution can be found in most stores. There are times when the container that retains the cleaning solution is not well suited for dispensing the proper amount of cleaning solution, and the resulting cleaning operation is either less than effective or the cleaning solution is wasted or over used. What is therefore needed is a cleaning brush with an integrated cleaning solution dispenser.

It is thus an object of the present invention to provide such a dispensing brush.

These and other objects of the present invention are not to be considered comprehensive or exhaustive, but rather, exemplary of objects that may be ascertained after reading this specification and claims with the accompanying drawings.

BRIEF SUMMARY OF THE INVENTION

In accordance with the present invention, there is provided a dispensing brush comprising a handle attached to a brush substrate; the brush substrate comprising a plurality of bristles; a reservoir for liquid retention; a pump capable of receiving liquid from the reservoir; a dispensing nozzle to deliver liquid from the pump; a lever mechanically coupled to the pump such that movement of the lever causes actuation of the pump and subsequent dispensing of the liquid.

The foregoing paragraph has been provided by way of introduction, and is not intended to limit the scope of the invention as described in this specification, claims and the attached drawings.

BRIEF DESCRIPTION OF THE DRAWINGS

The invention will be described by reference to the following drawings, in which like numerals refer to like elements, and in which.

Figure 1:
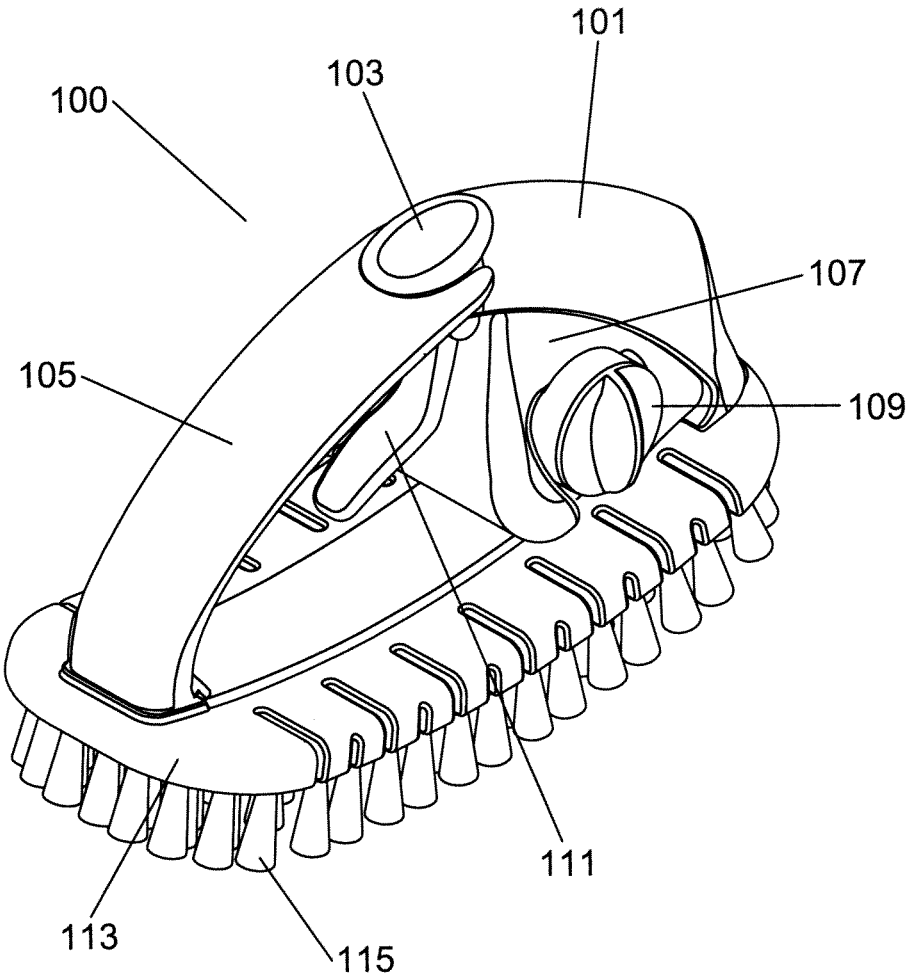
FIG. 1 is a perspective view of a dispensing brush of the present invention.

The attached figures depict various views of the dispensing brush in sufficient detail to allow one skilled in the art to make and use the present invention. These figures are exemplary, and depict a preferred embodiment; however, it will be understood that there is no intent to limit the invention to the embodiment depicted herein. On the contrary, the intent is to cover all alternatives, modifications, and equivalents as may be included within the spirit and scope of the invention as defined by this specification, claims and drawings.

DESCRIPTION OF THE PREFERRED EMBODIMENTS

A Dispensing Brush is described and depicted by way of this specification and the attached drawings.

For a general understanding of the present invention, reference is made to the drawings. In the drawings, like reference numerals have been used throughout to designate identical elements.

The Dispensing Brush of the present invention, as described and depicted herein, provides, among other things, a novel liquid reservoir and dispensing mechanism that delivers a liquid such as a cleaning solution toward the working surface of the brush, thus improving the efficiency of the cleaning process and providing improved cleaning.

FIG. 1 is a perspective view of a dispensing brush of the present invention. The dispensing brush may be made from any suitable material, for example, a plastic. Examples of suitable plastics include acrylonitrile butadiene styrene (ABS), polyethylene, polypropylene, polystyrene, polyvinyl chloride, polytetrafluoroethylene, and the like. Bioplastics may also be used in some embodiments of the present invention. In addition, reinforced plastics, metals, wood, or other materials that may be suitably formed may also be used. The various components of the dispensing brush may be made by injection molding, blow molding, machining, extruding, forming, or the like. The various components are then assembled in accordance with the instructions and figures provided herein.

Figure 2:
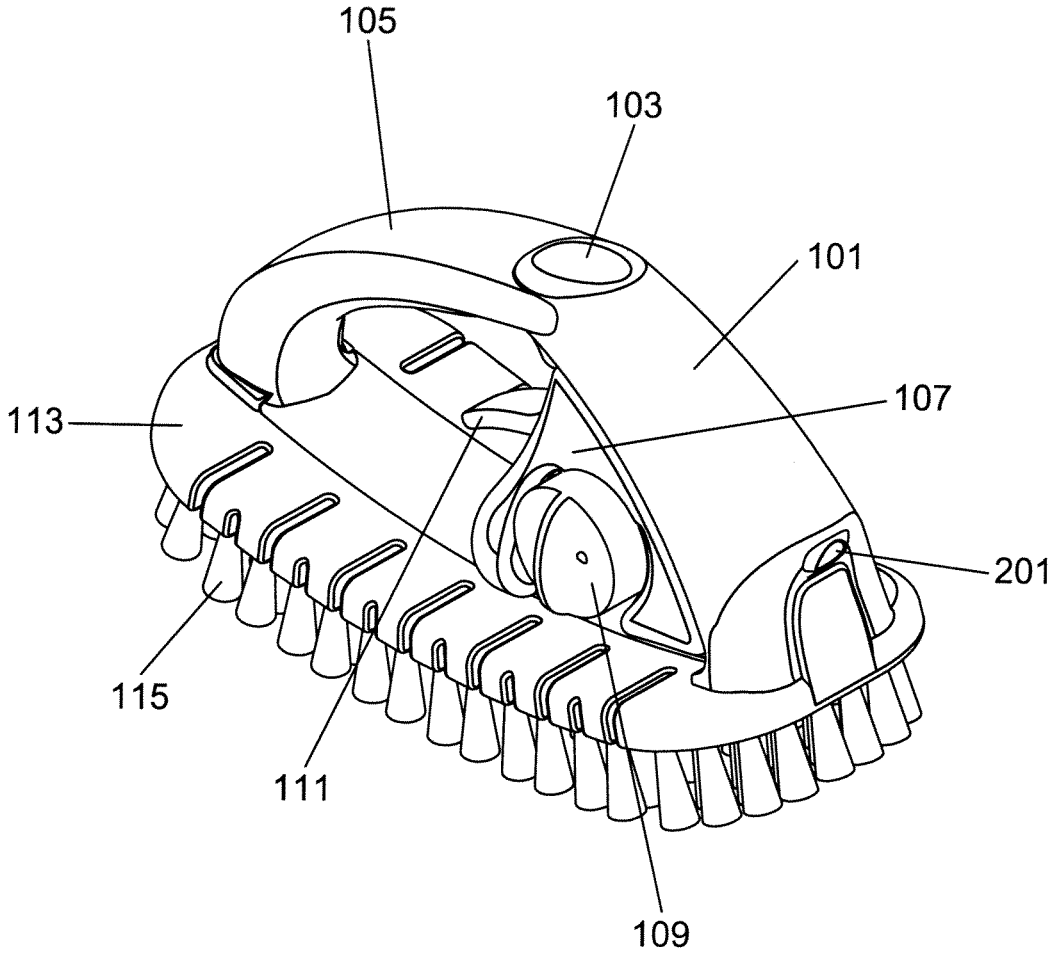
FIG. 2 is a rotated perspective view of the dispensing brush.
Figure 9:
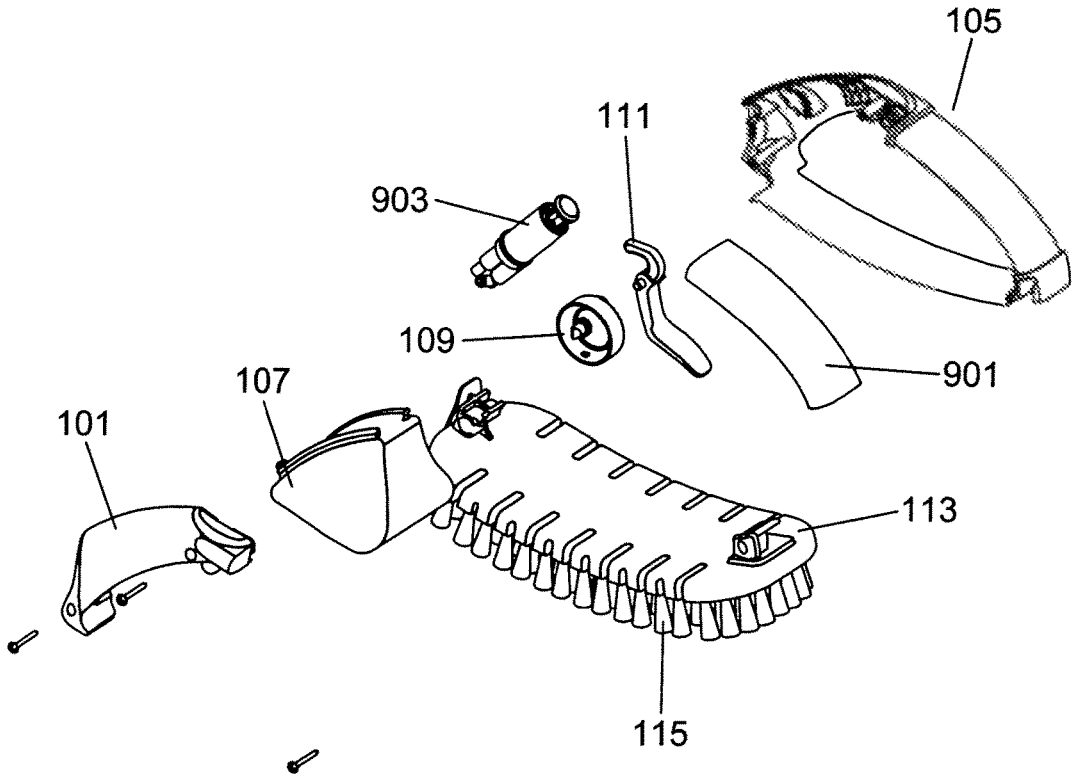
FIG. 9 is an exploded view of the dispensing brush.

As can be seen in FIG. 1, a dispensing brush 100 is shown comprising a handle and related handle assembly 105 attached to a brush substrate 113. The brush substrate 113 comprises a plurality of bristles 115 that protrude outwardly from the substrate 113 and may also be grouped together to form groups of bristles where in one embodiment each group comprises between 2 and 100 bristles. A reservoir 107 for liquid retention can also be seen fixed below the handle and may, in some embodiments of the present invention, be shaped to conform to the underside of the handle. A pump (as shown in FIG. 9 as 903) is also part of the dispensing brush 100 and is capable of receiving liquid from the reservoir 107 when so filled. A dispensing nozzle 201, as can be seen in FIG. 2, is arranged to deliver liquid contained in the reservoir through the action of the pump 903. A lever and related pump actuator lever assembly 111 is mechanically coupled to the pump 903 (as seen in FIG. 9) such that movement of the lever causes actuation of the pump and subsequent dispensing of the liquid contained in the reservoir 107. The reservoir 107 can be seen clearly attached to the dispensing brush 100 such that it is integral with the dispensing brush 100 during a cleaning operation.

The handle assembly 105 comprises a front support beam 101 that is curved to conform to a user's hand and provides adequate width and structural integrity to support the reservoir 107. In some embodiments of the present invention, the handle assembly 105 is made in two or more parts to accommodate placement of a pump and related structural elements within and attached thereto. Such structural details are shown by way of example, and not limitation, in FIG. 9. The front support beam transitions into the main handle where a thumb rest 103 can be seen. The thumb rest may simply be a flattened area of the handle or may, in some embodiments of the present invention, be depressed or concave to more comfortably support the thumb or appendage of a user. As seen and taught by way of example in FIG. 1, the reservoir 107 is generally wedge shaped to best accommodate it's location under and attached to the front support beam 101 and related handle assembly 105. The reservoir 107 may be made from a clear, opaque, or translucent plastic such that the contents of the reservoir, and their depletion level, can be clearly seen by the user. The shape of the reservoir 107 may also vary along a vertical dimension such that there is additional ability to accommodate cleaning solution toward the bottom area of the reservoir 107. A reservoir cap 109 can also be seen in FIG. 1 attached to the side (vertical wall) of the reservoir 107. The placement of the reservoir cap 109 may vary, with some embodiments of the present invention placing the reservoir cap on the top or bottom horizontal surfaces of the reservoir 107. The reservoir cap 109 may also be placed at an angle to any side by appropriate modification of the shape of the reservoir through tooling and related computer aided design (CAD). Further, the reservoir wall where the reservoir cap 109 is placed may protrude outward past the reservoir cap 109 in order to accommodate more cleaning solution and further to provide a more positive area for the reservoir cap to be situated.

Under the handle assembly 105 can also be seen a pump actuator lever assembly 111 that can be gripped and moved by a user to in turn move and actuate a pump that moves the cleaning solution or similar liquid from the reservoir 107 and out a nozzle (such details to be later described with the assistance of subsequent figures). The pump actuator lever assembly 111 may, in some embodiments of the present invention, be bent or angled such that a portion of the pump actuator lever assembly 111 is generally parallel to the handle (although variations on such parallel precision may be a matter of design choice, and a curved or otherwise non-parallel pump actuator lever assembly portion may be employed). The pump actuator lever assembly 111 also contains further structural components that will be further depicted and described by way of FIG. 12.

As can also be seen in FIG. 1, a brush substrate 113 can be seen with attached bristles 115. The brush substrate 113 may be curved in some embodiments to provide a better overall cleaning for it. The brush substrate 113 may also comprise slots completely through the brush substrate, and may also comprise slots that are only partially through the thickness of the brush substrate 113. These various slots may be fashioned singularly, or may alternate such that the fully through slots and the partially through slots are adjacent each other in an alternating arrangement. In some embodiments of the present invention, the brush substrate 113 may be flexible or semi-flexible due to variables such as choice of material, thickness of material, number of slots, and the like. As will be further seen in subsequent figures, the brush substrate 113 is attached to the handle assembly 105 and a brush substrate strut and brush substrate retention fixture may further be employed to facilitate structural attachment of the handle to the substrate and related bristles. Such further details can be seen by way of example in FIG. 13. The bristles 115 may be made from any suitable fibrous, stranded, or related material such as a plastic, metal, natural fiber, synthetic fiber, or the like. The bristles 115 may be pressed into holes in the substrate 113, molded in place, glued or bonded in place, or the like.

FIG. 2 is a rotated perspective view of the dispensing brush that clearly shows the dispensing nozzle 201. The dispensing nozzle 201 is directed toward the leading edge or cleaning surface of the dispensing brush 100 in such a way that cleaning solution or similar liquid is deposited on the surface to be cleaned. The user may chose to dispense the cleaning solution or liquid while scrubbing with the dispensing brush 100, or may lift the dispensing brush 100 away from the cleaning surface and direct the dispensing nozzle 201 at an area where the cleaning solution is to be applied. In this manner, the user can carry the dispensing brush 100 without the need to carry and pick up a brush and cleaning solution dispensing bottle separately. Such convenience not only saves time, but through the precise application of cleaning solution also saves unnecessary consumption of cleaning solution during a cleaning task. In some embodiments of the present invention, the dispensing nozzle 201 is adjustable to change the spray pattern and/or delivery volume. The adjustment may be made by rotation of the nozzle, insertion of a screwdriver blade and subsequent rotation of the nozzle, or the like.

The reservoir cap 109 can also be seen in FIG. 2 as having a grip for ease of rotation and removal. The grip may be a longitudinal span, a knob, a point, knurls, other geometries, or simply the reservoir cap itself.

Figure 3:
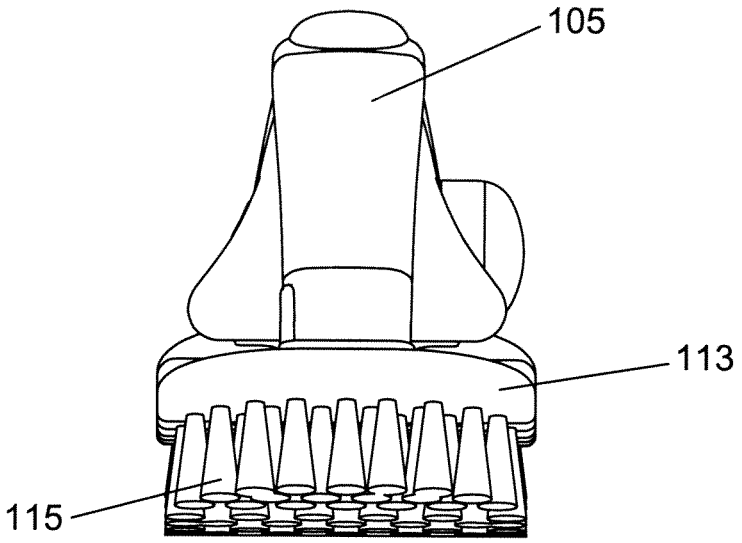
FIG. 3 is a rear plan view of the dispensing brush.

FIG. 3 is a rear plan view of the dispensing brush where another perspective of the handle assembly 105 can be seen.

Figure 4:
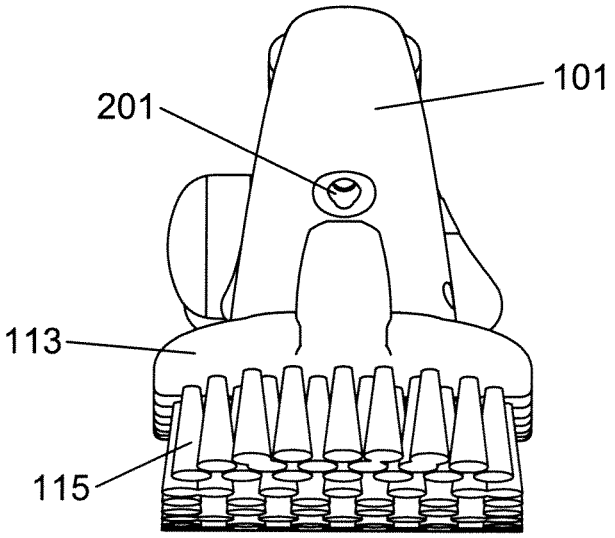
FIG. 4 is a front plan view of the dispensing brush.

FIG. 4 is a front plan view of the dispensing brush showing clearly the placement of the dispensing nozzle 201. As previously stated, the nozzle may be adjustable and further may be directional.

Figure 5:
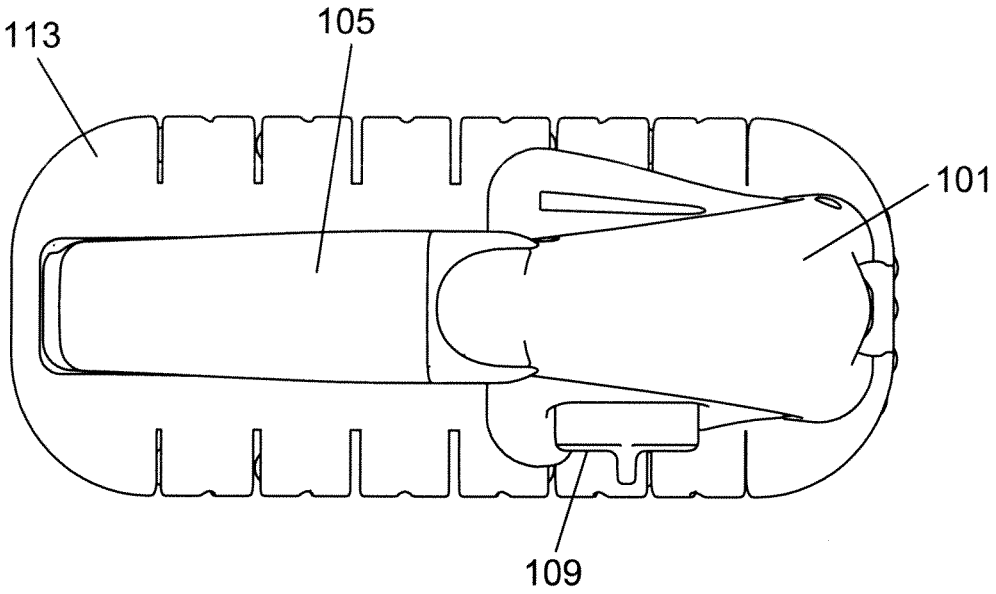
FIG. 5 is a top plan view of the dispensing brush.

FIG. 5 is a top plan view of the dispensing brush. The flared bottom of the reservoir and the placement of the reservoir under the handle can be seen. The front support beam 101 of the handle assembly 105 is seen to be progressively larger than the handle itself in this exemplary embodiment. This larger size provides not only structural rigidity, but also accommodates internal placement of the pump, as shown in FIG. 9.

Figure 6:
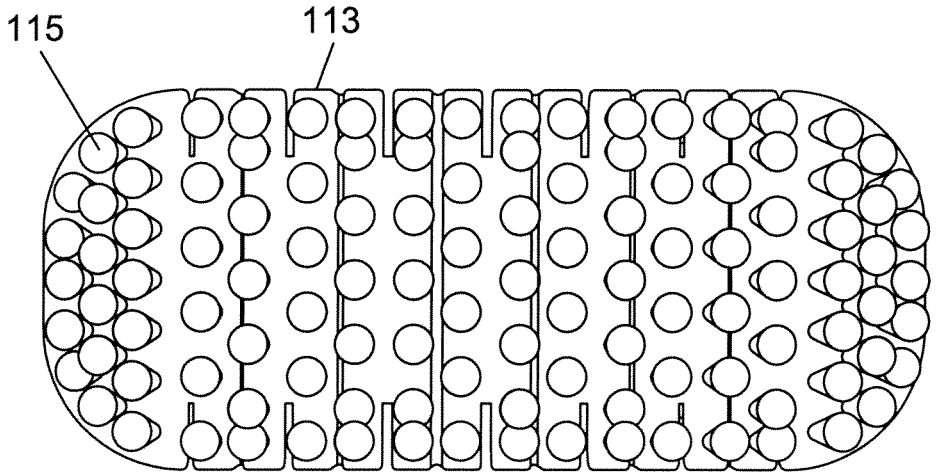
FIG. 6 is a bottom plan view of the dispensing brush.

FIG. 6 is a bottom plan view of the dispensing brush. The bristles 115 can be seen attached to the brush substrate 113. Slots can also be seen that traverse the width of the substrate 113 and also traverse only a part of the width of the substrate 113.

Figure 7:
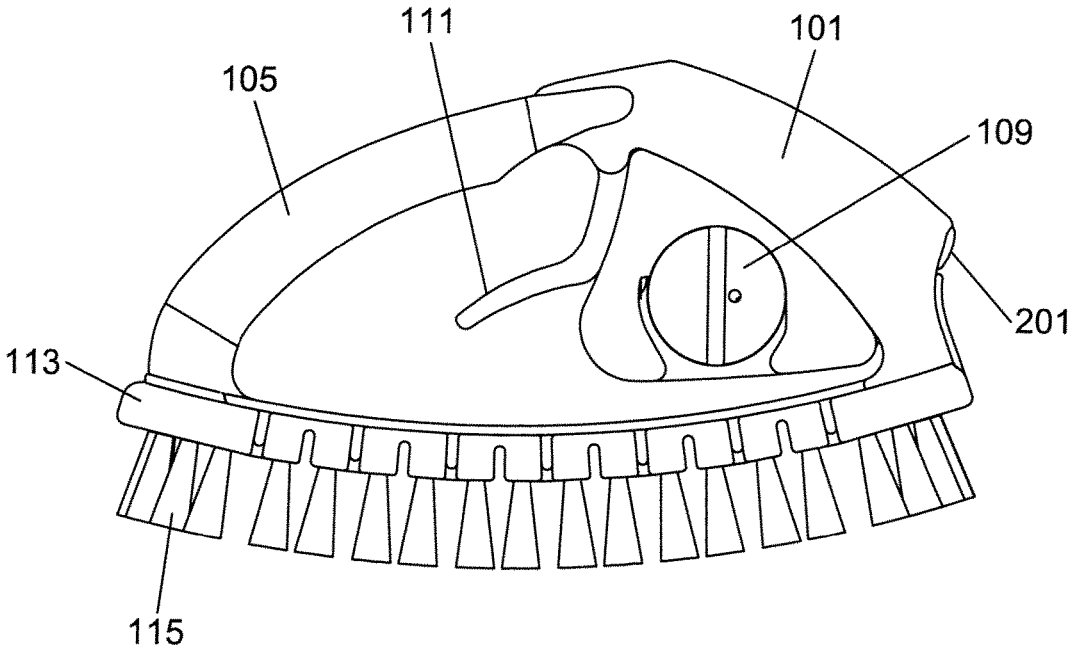
FIG. 7 is a side plan view of the dispensing brush.

FIG. 7 is a side plan view of the dispensing brush that further shows the pump actuator lever and the angle thereof. Placement of the reservoir 107 in relation to the handle assembly 105 can also be seen as well as the exemplary slots or cuts in the brush substrate 113.

Figure 8:
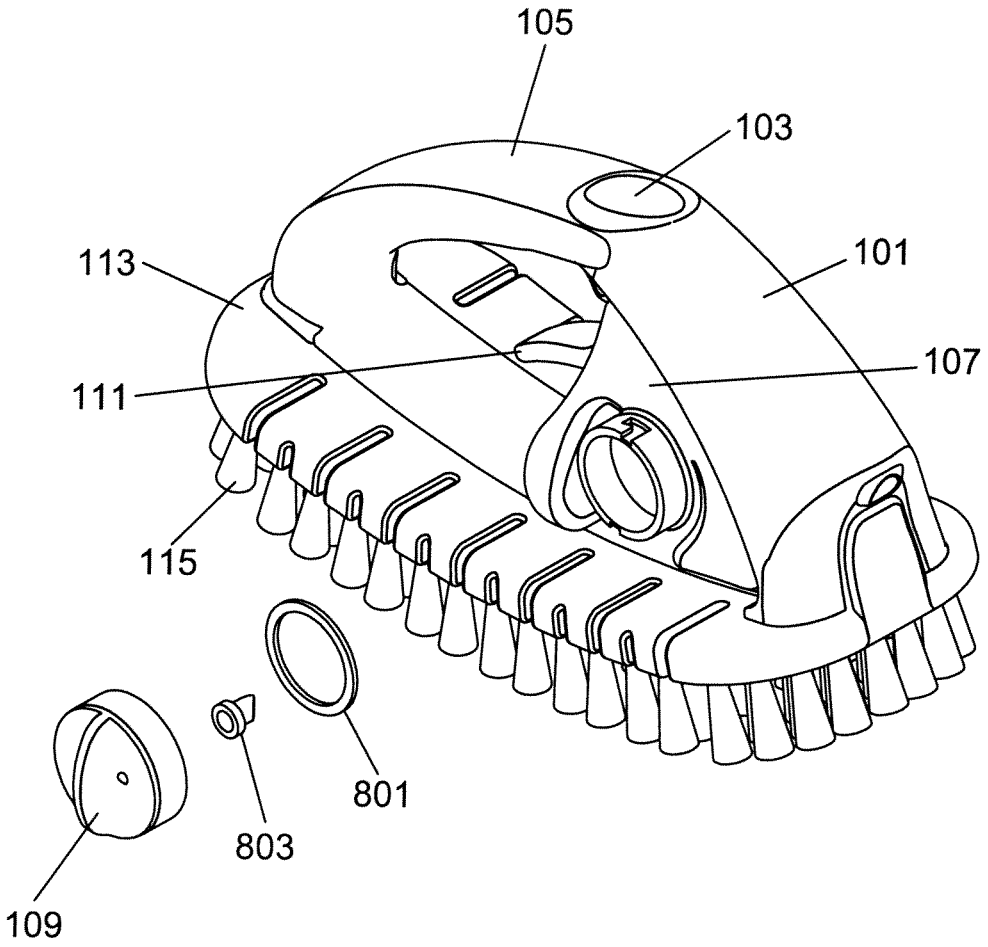
FIG. 8 is a perspective view of the dispensing brush showing the reservoir cap disassembled.
Figure 10:
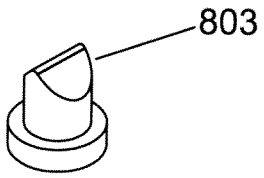
FIG. 10 depicts a taper valve of the reservoir cap.

FIG. 8 is a perspective view of the dispensing brush showing the reservoir cap disassembled. The transverse grip on the reservoir cap 109 can be seen along with a gasket seal 801 to provide a liquid tight seal when the reservoir cap 109 is properly attached to the reservoir 107. The gasket seal 801 may be a flat annular seal that is retained by a lip or recess on the reservoir cap itself, or may be an O-ring or the like. The gasket seal may be made from any soft durometer material suitable for liquid tight sealing, such as rubber, silicone rubber, various expanded or closed cell synthetic materials, cork, or the like. Also, a taper valve 803 can be seen that provides for replacement air into the reservoir 107 as liquid is being dispensed. FIG. 10 shows a close up view of this taper valve. The taper valve 803 brings two edges of material into close contact such that in one direction the edges are tight and in the other direction the edges are loose to allow for the passage of air while excluding the entry of liquid in an opposite direction. The taper valve 803 uses edges that are tapered or angled toward each other to accomplish this objective, and allows the reservoir cap 109 to be placed on a vertical wall of the reservoir 107 without leaking.

FIG. 9 is an exploded view of the dispensing brush. A handle overlay 901 can be seen as an optional item to provide comfort to the user, as the handle overlay is made from a soft durometer material, and may cover the entire handle or a portion thereof. A pump 903 can also be seen that provides fluid communication and fluid delivery between the reservoir 107 and the dispensing nozzle 201 that is depicted in FIG. 2. The reservoir 107 has an opening or hole that is in turn connected to the pump 903 for the entry and subsequent expulsion of liquid previously contained in the reservoir 107. The pump 903 may be any form of mechanical pump including a piston actuated or diaphragm style pump. In FIG. 9, the pump 903 is mechanically coupled to the pump actuator lever assembly 111 by way of a cam feature that provides translational force from the lever piece through a curved cam structure and into a linear drive of the pump 903 where the linear drive includes a stem or similar surface to receive the force from the cam and transfer it to a piston or fluid moving arrangement within the pump to force liquid from the reservoir 107 and out the dispensing nozzle 201 with force sufficient to broadcast or spray the liquid onto a surface to be cleaned. In some embodiments of the present invention the pump 903 is an electrically driven pump that is actuated through a lever, button or switch that contains electrical contacts.

FIG. 10 depicts a taper valve 803 of the reservoir cap. As previously described, the taper valve 803 is attached to a protrusion and opening on the reservoir cap 109 on the inward facing portion of the reservoir cap 109. The angled or tapered surfaces of the soft durometer material of the taper valve provide a liquid seal in one direction while allowing make up air to enter the reservoir 107 in the other direction.

Figure 11:
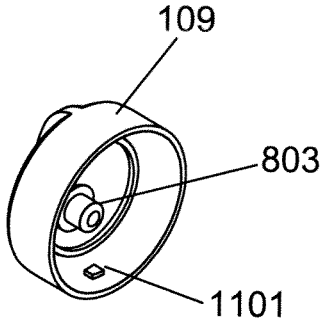
FIG. 11 depicts an engagement feature of the reservoir cap.

FIG. 11 depicts an engagement feature 1101 of the reservoir cap. This engagement feature may be a protrusion or recess that couples and locks with an opposing feature on the reservoir 107 along the surface where the reservoir cap 109 attaches to the reservoir 107.

Figure 12:
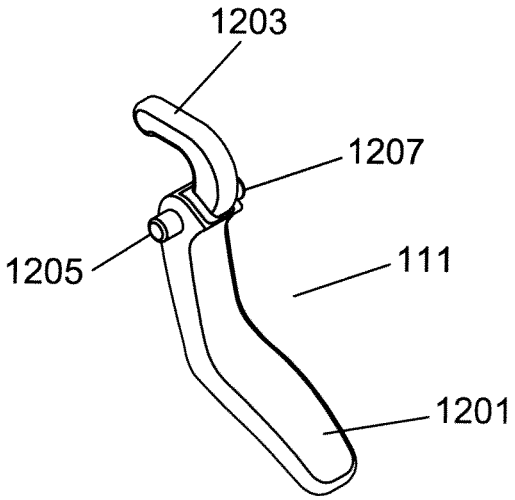
FIG. 12 depicts a pump actuator lever assembly of the dispensing brush.

FIG. 12 depicts a pump actuator lever assembly 111 of the dispensing brush. A lever 1201 can be seen with a flattened or otherwise ergonomic surface to allow interaction by a user. Such interaction includes repeated movement of the lever 1201 to drive the pump 903 (see FIG. 9) and expel liquid from the dispensing nozzle 201 (see FIG. 2). A pump engagement cam 1203 can also be seen mechanically coupled or formed with the lever 1201. The pump engagement cam 1203 provides translational force from the lever 201 through a cam 1203 and into a linear drive of the pump 903 where the linear drive includes a stem or similar surface to receive the force from the cam 1203 and transfer it to a piston or fluid moving arrangement within the pump to force liquid from the reservoir 107 and out the dispensing nozzle 201 with force sufficient to broadcast or spray the liquid onto a surface to be cleaned. The pump engagement cam 1203 may be curved or angled to facilitate proper interaction between the lever 1201 and the pump 903 as seen in FIG. 9. To allow the pump actuator lever assembly 111 to pivot or hinge repeatedly in order to drive the pump, a first hinge pin 1205 and a second hinge pin 1207 can be seen protruding from the pump actuator lever assembly 111 at a suitable location such that recesses or similar features in the dispensing brush handle assembly 105 are able to receive and interact with the hinge pins such that movement occurs that is sufficient and adequate to drive the pump.

Figure 13:
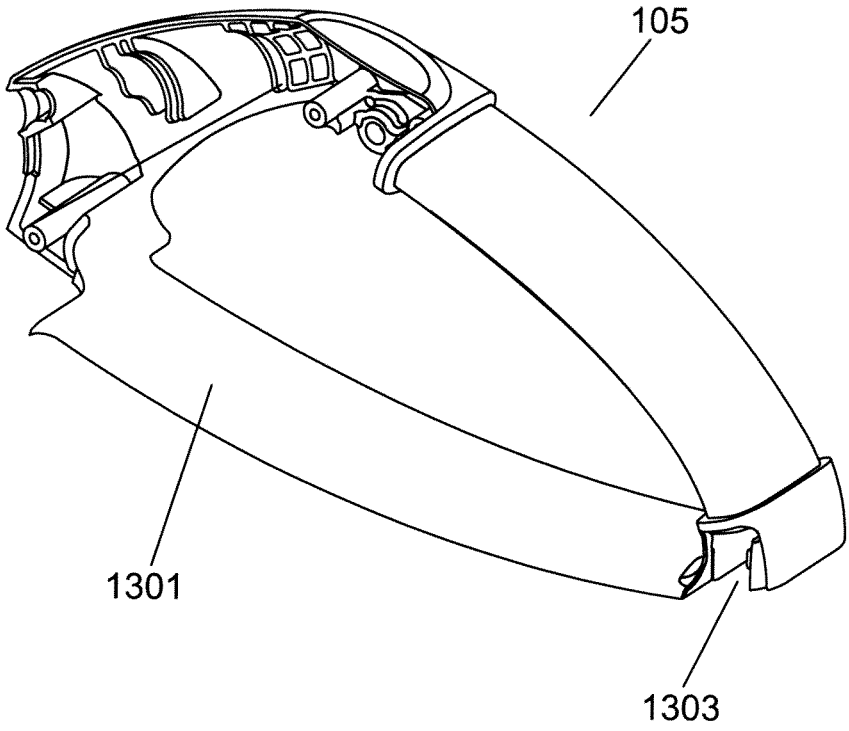
FIG. 13 depicts a handle assembly of the dispensing brush.

FIG. 13 depicts a handle assembly 105 of the dispensing brush. The various features within the handle assembly to accommodate the pump 903 (not shown in FIG. 13) can be seen. In addition, a brush substrate strut 1301 can be seen that has a generally flat appearance to accommodate attachment of the brush substrate to the handle assembly 105. A brush substrate retention feature 1303 can be seen where the brush substrate is mechanically fastened to the brush substrate strut 1301 and related handle assembly 105. In some embodiments of the present invention, the brush substrate strut 1301 is curved to conform to a curved brush substrate.

Figure 14:
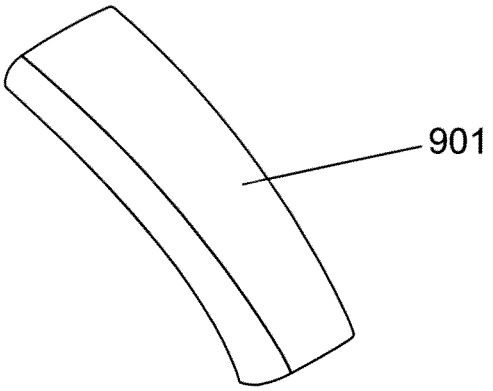
FIG. 14 depicts a handle overlay of the dispensing brush.

FIG. 14 depicts a handle overlay 901 of the dispensing brush. As previously stated, the handle overlay is made from a soft durometer material to provide a comfortable and secure grip for the user.

Figure 15:
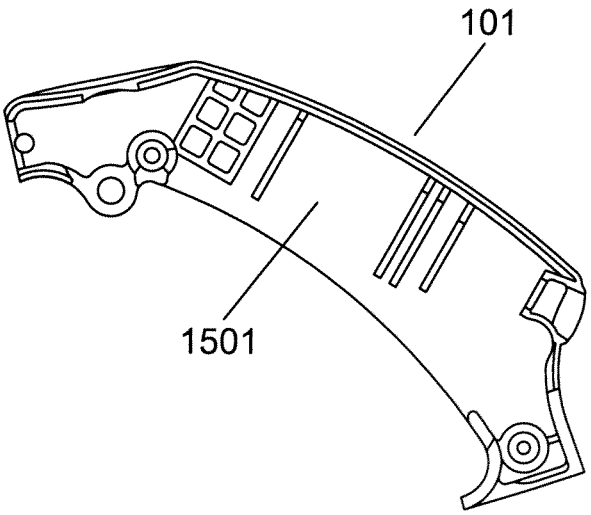
FIG. 15 depicts a handle half of the dispensing brush.
Figure 16:
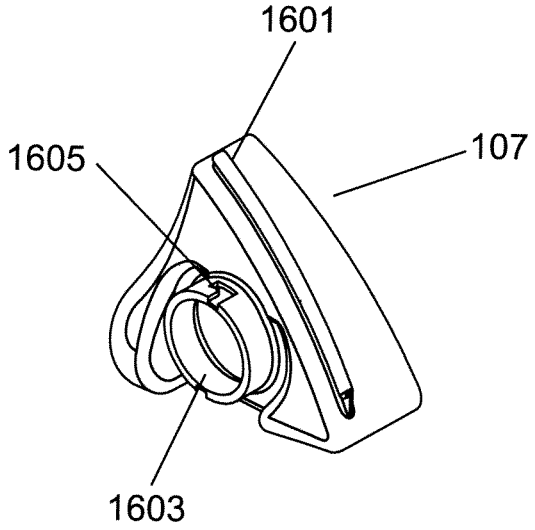
FIG. 16 depicts a reservoir of the dispensing brush.

FIG. 15 depicts a handle half 1501 of the dispensing brush. This handle half 1501 mates with the handle assembly 105 to form a handle that also incorporates the pump within the two pieces. Fastening features and pump retention features can be clearly seen in FIG. 15. As the two halves are joined together, the reservoir 107, as further depicted in FIG. 16, is retained by mechanical means such as a reservoir attachment protrusion 1601 that provides a protrusion, in one embodiment a linear protrusion, that can be captured and retained by the handle half 1501 and handle assembly 105 when formed or attached together. A reservoir fill opening 1603 can also be seen protruding from the reservoir 107 with at least one reservoir engagement feature 1605 that may include a slot, recess, or slot with an angled (such as right angled) opening in the reservoir fill opening 1603 to allow for engagement and retention of the reservoir cap 109 (not shown in FIG. 16).

Figure 17:
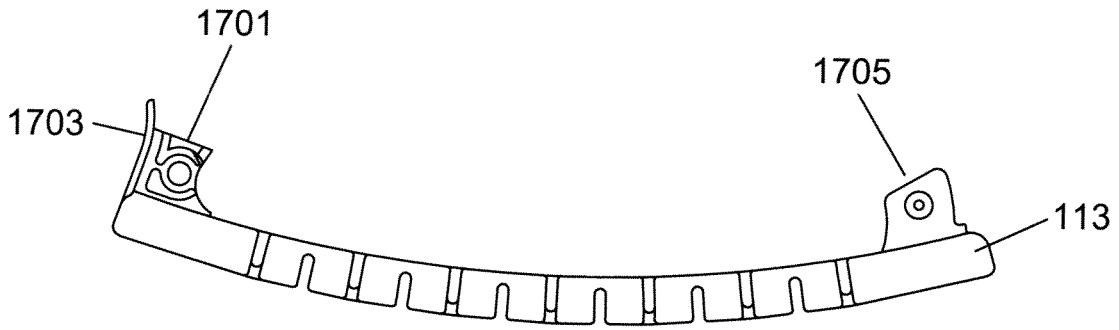
FIG. 17 is a side view of a brush substrate assembly of the dispensing brush.

FIG. 17 is a side view of a brush substrate assembly 113 of the dispensing brush. A front substrate strut attachment feature 1701 can be seen along with a rear substrate strut attachment feature 1705. The attachment features may be protrusions or recesses with mating geometries to allow attachment of the brush substrate 113 to the handle assembly 105. In addition, a front substrate stop 1703 can be seen to allow for placement and securement of the handle to the substrate while reducing stress on the attachment features while the dispensing brush is in use.

Figure 18:
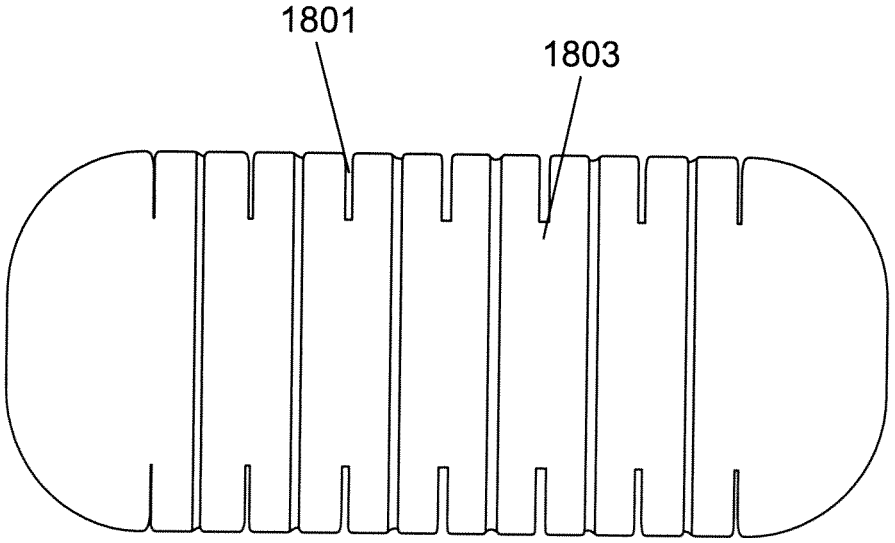
FIG. 18 is a plan view of the brush substrate assembly of the dispensing brush.
Figure 19:
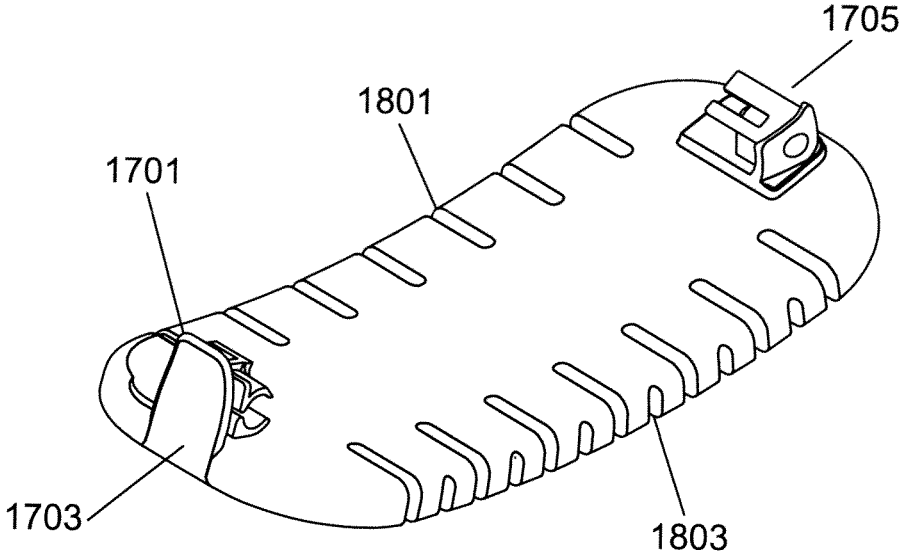
FIG. 19 is a perspective view of the brush substrate assembly of the dispensing brush.

FIG. 18 is a plan view of the brush substrate assembly 113 of the dispensing brush showing side cuts 1801 that alternate with full transverse cuts. In some embodiments of the present invention, the substrate is a curved substrate 1803. The perspective view of FIG. 19 better shows the curved substrate embodiment and also further depicts the attachment features 1701 and 1705 as well as the front substrate stop 1703.

Figure 20:
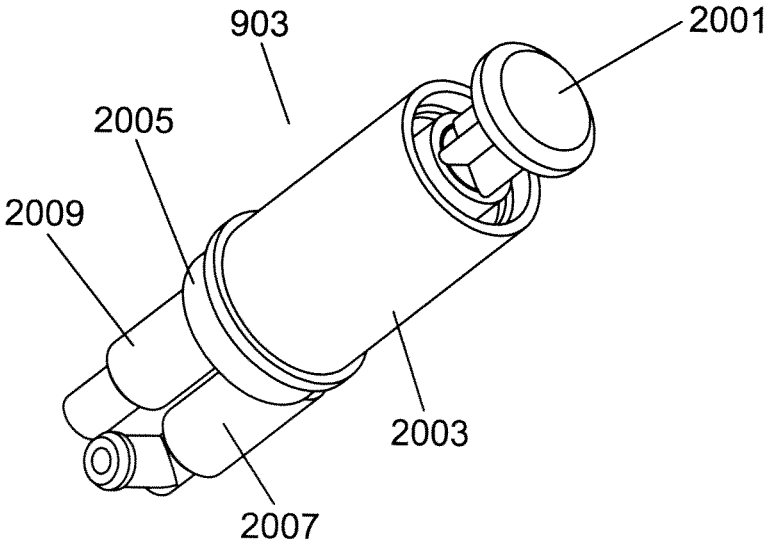
FIG. 20 is a perspective view of the pump of the dispensing brush.
Figure 21:
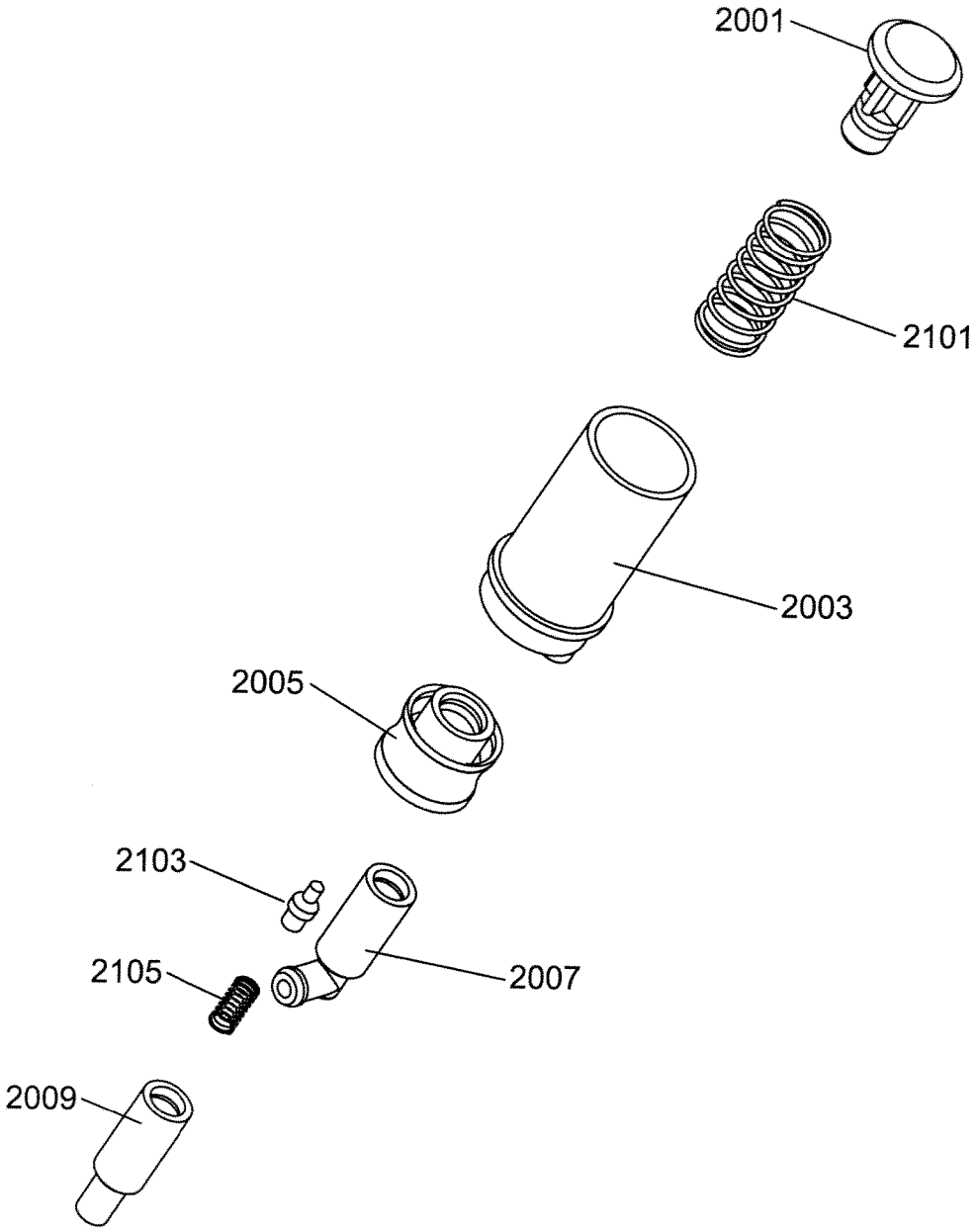
FIG. 21 is an exploded view of the pump of FIG. 20.

FIG. 20 is a perspective view of the pump 903 of the dispensing brush. Various embodiments of the present invention may employ various types of pumps. In this example, a linear piston style pump is depicted. A pump piston stem 2001 can be seen that provides a surface for the pump engagement cam to move when the pump actuator lever is moved. The pump piston stem 2001 is in turn connected to the pump piston (not show in FIG. 20, see FIG. 21). A pump cylinder 2003 houses and seals the pump piston and a pump body 2005 provides fluid communication between the pump cylinder 2003 and the pump intake 2007 and the pump discharge 2009. For both the pump intake 2007 and the pump discharge 2009 fittings can be seen to allow attachment to a hose, conduit, or the like. To show the inner workings of the exemplary pump 903, an exploded view of the pump can be seen in FIG. 21. A spring 2101 can be seen to return the piston 2103 to a given linear position in the cylinder. The piston 2103 also has seals to provide a liquid tight seal between the piston and the cylinder, thus allowing for movement and spray of the cleaning solution placed within the reservoir of the dispensing brush. A piston spring 2105 can also be seen to provide return force to the piston 2103 as it travels through the cylinder 2003. Seals such as O-rings and gaskets are used as necessary to provide for a liquid tight seal and associated pressurization and expulsion of cleaning solution by the pump 903.

To use the dispensing brush, cleaning solution or a similar liquid is placed in the reservoir and the reservoir then appropriately capped. A pump actuator lever is squeezed and released repeatedly, driving the liquid from the reservoir and through a dispensing nozzle. The dispensing brush is positioned such that the expelled liquid is deposited on a surface to be cleaned, and the dispensing brush is used to scrub and subsequently clean the surface. The dispensing brush provides a novel arrangement for dispensing cleaning solution or similar liquid in an efficient and cost effective manner, something heretofore not possible with separate dispensing bottles and cleaning brushes.

It is, therefore, apparent that there has been provided, in accordance with the various objects of the present invention, a dispensing brush. While the various objects of this invention have been described in conjunction with preferred embodiments thereof, it is evident that many alternatives, modifications, and variations will be apparent to those skilled in the art. Accordingly, it is intended to embrace all such alternatives, modifications and variations that fall within the spirit and broad scope of this specification, claims and the attached drawings.

What is claimed is:

1. A dispensing brush comprising:
a handle assembly and a handle half that mates with the handle assembly;
a front support beam connecting the handle assembly to a brush substrate;
the brush substrate comprising a plurality of bristles;
a wedge shaped reservoir for liquid retention having a reservoir cap and attached to the underside of the front support beam;
a pump for dispensing liquid retained in the reservoir;
the pump for dispensing liquid being embedded within and surrounded by the mated handle assembly and handle half;
a fluid channel from the reservoir to the pump;
a dispensing nozzle with a fluid channel to the pump;
the pump being actuated by user interaction with a lever located within an opening made by the conjoining of the handle assembly, front support beam and brush substrate;
wherein the lever is mechanically linked to the pump through a curved cam structure such that movement of the lever translates to linear actuation of the pump and subsequent dispensing of the liquid through the dispensing nozzle.

2. The dispensing brush of claim 1, wherein the reservoir cap is located on a vertical wall of the reservoir.

3. The dispensing brush of claim 1, wherein the reservoir cap further comprises a taper valve for admission of make up air into the reservoir while preventing liquid in the reservoir from leaking out.

4. The dispensing brush of claim 1, wherein the dispensing nozzle protrudes through the handle assembly.

5. The dispensing brush of claim 1, wherein the pump is a linear piston and cylinder pump.

6. The dispensing brush of claim 1, wherein the handle assembly further comprises a thumb rest.

7. The dispensing brush of claim 1, wherein the pump is located within the handle assembly.

8. The dispensing brush of claim 1, wherein the pump further includes a spring to provide return of the interacting lever while the lever is operated by a user.

9. The dispensing brush of claim 1, wherein the brush substrate is curved.

10. The dispensing brush of claim 1, wherein the brush substrate comprises side cuts.

11. The dispensing brush of claim 1, further comprising a handle overlay located along a gripping section of the handle assembly.

12. A dispensing brush comprising:
a handle assembly and a handle half that mates with the handle assembly;
a front support beam connecting the handle assembly to a brush substrate;
the brush substrate comprising a plurality of bristles;
a wedge shaped reservoir for liquid retention attached to the underside of the front support beam;
a pump in fluid communication with the reservoir;
the pump being embedded within and surrounded by the mated handle assembly and handle half;

a dispensing nozzle in fluid communication with the pump;

a lever located within an opening made by the conjoining of the handle assembly, front support beam and brush substrate; the lever being mechanically coupled to the pump through a curved cam structure such that movement of the lever translates to linear actuation of the pump and subsequent dispensing of the liquid through the dispensing nozzle.

13. The dispensing brush of claim 12, wherein the dispensing nozzle is attached to the handle assembly.

14. The dispensing brush of claim 1, wherein the pump is located within the handle assembly.

15. The dispensing brush of claim 1, wherein the brush substrate is curved.

16. A dispensing brush comprising:

a handle attached to a brush substrate;

the handle comprising a handle assembly and a handle half that mates with the handle assembly;

a front support beam connecting the handle with the brush substrate;

the brush substrate comprising a plurality of bristles;

a wedge shaped reservoir for liquid retention;

the wedge shaped reservoir connected to the underside of the front support beam;

a pump capable of receiving liquid from the reservoir;

the pump being embedded within and surrounded by the mated handle assembly and handle half;

a dispensing nozzle to deliver liquid from the pump;

a lever located within an opening made by the conjoining of the handle assembly, front support beam and brush substrate; the lever being mechanically coupled to the pump through a curved cam structure such that movement of the lever translates to linear actuation of the pump and subsequent dispensing of the liquid.

* * * * *